United States Patent [19]

Meijer

[11] 4,392,342

[45] Jul. 12, 1983

[54] CABLE STRANDING APPARATUS AND METHOD OF OPERATING IT

[75] Inventor: Johan F. R. Meijer, Zaandam, Netherlands

[73] Assignee: N.K.F. Groep B.V., Rijswijk, Netherlands

[21] Appl. No.: 261,430

[22] Filed: May 7, 1981

[30] Foreign Application Priority Data

May 14, 1980 [NL] Netherlands ..... 8002786

[51] Int. Cl.[3] ..... D07B 3/06; D07B 7/06

[52] U.S. Cl. ..... 57/264; 57/93; 57/94; 242/45

[58] Field of Search ..... 57/19, 264, 265, 6, 57/13, 58.34, 58.86, 93, 94; 242/36, 39, 45

[56] References Cited

U.S. PATENT DOCUMENTS

| | | | |
|---|---|---|---|
| 2,214,332 | 9/1940 | Kline | 242/45 X |
| 2,214,333 | 9/1940 | Walsh et al. | 242/45 |
| 3,393,503 | 7/1968 | Lucas | 57/94 |
| 3,566,596 | 3/1971 | Pennycuik et al. | 57/264 X |
| 3,943,689 | 3/1976 | Kunz et al. | 57/264 |

FOREIGN PATENT DOCUMENTS

| | | | |
|---|---|---|---|
| 787549 | 12/1957 | United Kingdom | 242/39 |
| 2020854 | 11/1979 | United Kingdom . | |

*Primary Examiner*—Donald Watkins
*Attorney, Agent, or Firm*—David R. Treacy

[57] ABSTRACT

A method of, and apparatus for, manufacturing a stranded product from materials wound on feed reels journalled in a rotating feed cage. To permit operation at a maximum safe speed based on centrifugal force of the mass of material on the feed reels, an energy beam such as light is arranged to sense the diameter of the various feed reels. Cage rotation is then increased as permitted according to the observed diameter of charge of material on the reel having the greatest charge.

11 Claims, 5 Drawing Figures

CABLE STRANDING APPARATUS AND METHOD OF OPERATING IT

The invention relates to a method of manufacturing stranded products, such as cables, where a number of wires are pulled from feed reels which are journalled in a feed cage, are fed through a stranding device and are stranded in order to form a stranded product which is subsequently wound onto a take-up reel, the speed of rotation of the reels being gradually adapted to the varying charge of, that is, the amount of wire wound on, the reels. The mass of the charge is determined by monitoring the diameter of the material wound on the reels.

A method of this kind is known from German Offenlegungsschrift No. 28 31 604. According to the known method, the speed of rotation of the feed cage is gradually increased as the charge of the feed reels decreases, the charge of the reels being monitored by means of proximity switches; the feed reels are journalled in the feed cage so that their center line extends parallel to the axis of the feed cage.

The present invention has for its object to improve the known method, to increase the speed of rotation and to reduce the risk of breakdowns.

The object in accordance with the invention is achieved mainly in that the reels are monitored by means of an energy beam of a given wavelength. For this purpose use can be made of a light beam in the form of an infrared beam, laser beam, light curtain or of ultrasonic waves.

As a result of the gradual increase of the speed of rotation of the feed reels or the feed cage as reduction of the charge of the reels is sensed, a production increase of from 10% to 50%, depending on the product, is comparatively simply realized. Similarly, the speed of rotation of the take-up reels can be gradually decreased as the charge increases, so that winding can always take place with an optimum number of revolutions; notably the winding process can be started at an optimum speed. Because the speed of rotation is linked to the varying rotating mass in accordance with the invention, the centrifugal force can be maintained at a constant value which may be a maximum permissible value.

The method in accordance with the invention can be used for the manufacture of steel cables, electrical cables and parts thereof, for example, for the stranding of single or multiple wires or electrical conductors, for the armouring of products with wire or with a strip-shaped material, and also for the manufacture of stranded products in general made by stranding materials supplied from feed reels.

The invention also relates to a device for performing the method, comprising a feed cage with feed reels, a stranding device, a take-up cage with a take-up reel, a drive, and a monitoring device; this device in accordance with the invention is characterized in that, viewed in the longitudinal direction of the device, at least one transmitter and at least one receiver are arranged in front of and behind the driven cage, said transmitter and receiver each being mounted on a slide comprising a motor, a potentiometer which influences the speed of rotation of the driven cage being coupled to one of the motors.

In the case of a rotating feed cage the transmitter and the receiver are situated so that the charge of the feed reels just interrupts the beam. When all reels have been discharged so far that the beam is no longer interrupted, the two slides are displaced by the motors until the beam is interrupted again by the feed reels. At the same time the speed of rotation of the device is increased by means of the potentiometer.

In the case of a rotating take-up reel, the beam emitted by the transmitter is interrupted as the charge on the reel increases. Both slides arethen displaced in the radial direction, so that the receiver can receive the signal again. At the same time the speed of rotation of the take-up reel is decreased by means of the potentiometer.

In a preferred embodiment of the device in accordance with the invention, the receiver is connected to a counter. This embodiment is particularly suitable for use in combination with a rotating feed cage where the charge of all feed reels is scanned by a single beam.

A preferred embodiment of the device in accordance with the invention is characterized in that in their extreme position the slides cooperate with limit switches which determine the maximum speed of rotation of the device.

The maximum speed of rotation can be calculated and determined so that the maximum permissible centrifugal force will definitely not be exceeded. Because the centrifugal force increases as the square of the angular velocity, the speed of rotation cannot be increased until the reel is completely empty; the described steps ensure that the maximum permissible centrifugal force is not exceeded.

A further preferred embodiment of the device in accordance with the invention is characterized in that in their starting position the slides cooperate with limit switches which control a locking relay for the drive of the device. This important safety step ensures that the device cannot start with an excessively high speed once it has come to a standstill. Both slides first have to return to the starting position, so that the locking relay release the power supply for the drive via the two limit switches, so that the device starts again with the lowest number of revolutions.

The invention will be described in detail hereinafter with reference to the accompanying diagrammatic drawing.

Figure 1:
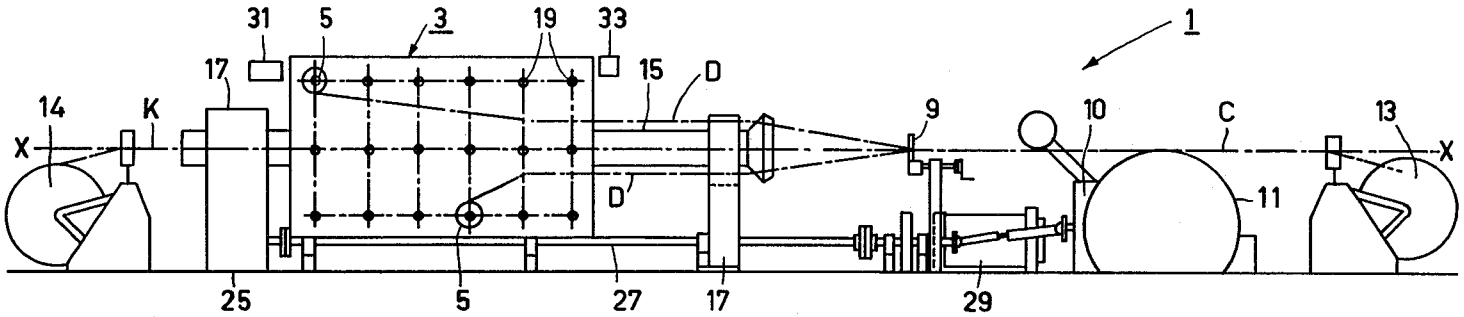
FIG. 1 is a side elevation of an embodiment of the device in accordance with the invention.
Figure 2:
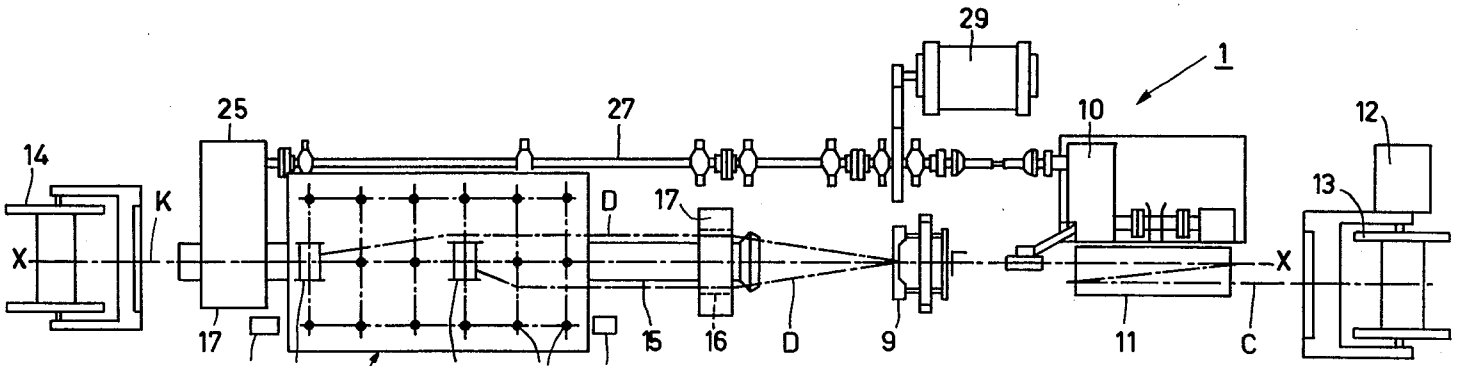
FIG. 2 is a plan view of the device shown in FIG. 1.

The FIGS. 1 and 2 show a device 1 for the stranding of wires in order to form a conductor which comprises a rotating feed cage 3 with feed reels 5, a stranding nozzle 9, a pull-through disc 11 and a take-up reel 13. The feed cage 3 consists mainly of a hollow cage shaft 15 which is rotatably journalled in bearing blocks 17. The feed reels 5 are journalled to be freely rotatable in known manner on shafts which are diagrammatically denoted by the reference numeral 19 and which are rigidly connected to the cage shaft 15 and are uniformly distributed over the circumference and the length of the cage shaft. The drawing shows only a few reels for the sake of clarity. X-X denotes the common centre line of the feed cage 3 and the stranding nozzle 9. An electric motor 29 and a multiple drive shaft 27 drive the feed cage 3 via a gear box 25 and the pull-through disc 11 via a transmission 10. The take-up reel 13 is driven by a separate motor 12.

In accordance with the invention, the device comprises a light source 31 and a photocell 33 which are arranged in front of and behind the feed cage, respectively.

Figure 3:
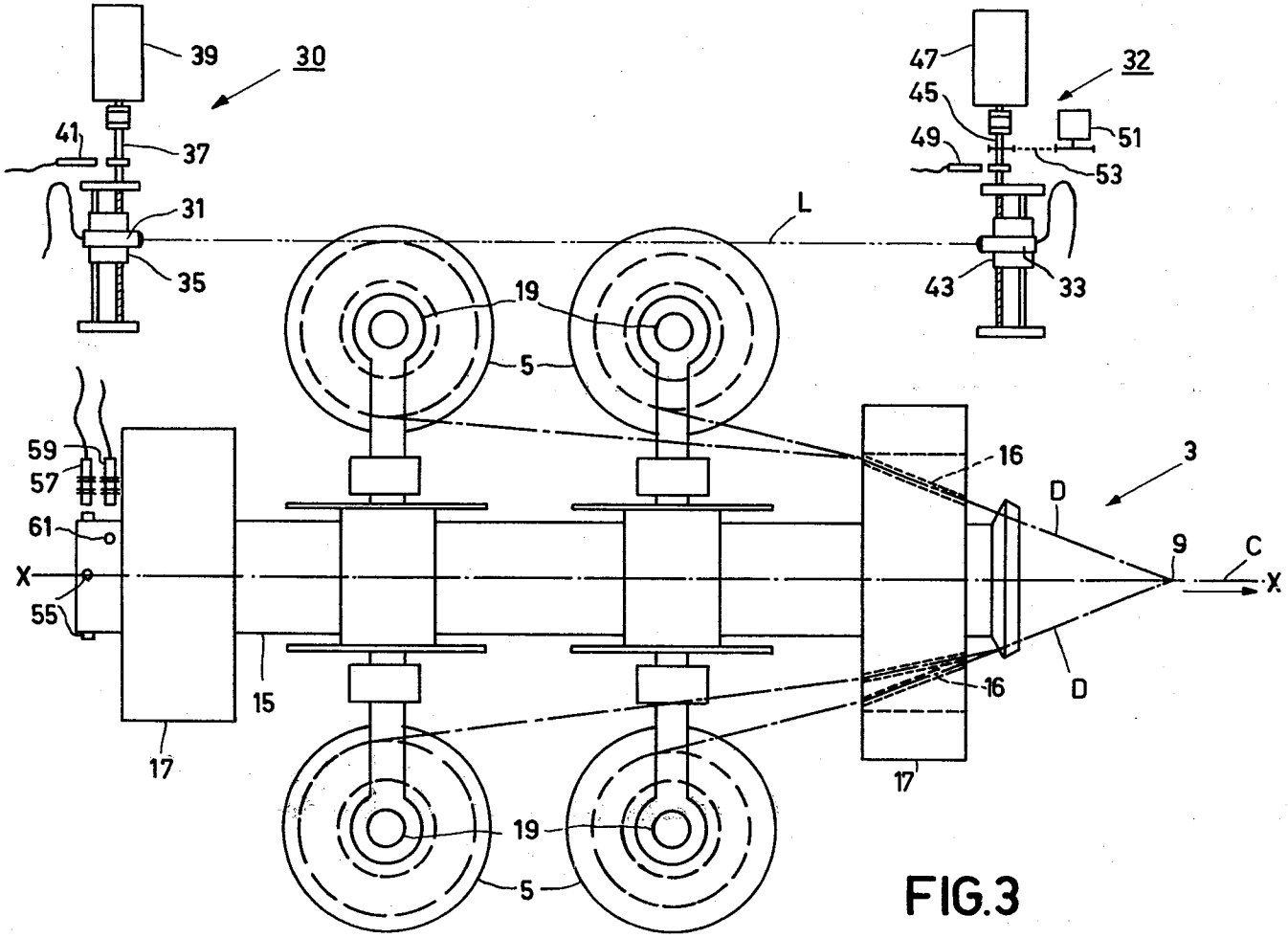
FIG. 3 shows the feed cage at an increased scale.

FIG. 3 diagrammatically shows the feed cage 3 and the light source 31 and the photo cell 33, forming part of units 30 and 32, respectively, at an increased scale. The light source 31 is mounted on a slide 35 which can be displaced by a motor 39 via a drive shaft 37. The reference numeral 41 indicates an initiator (counter-emitter) which, as is described later, senses the angular rotation of the shaft 37. Similarly, the photo cell 33 is mounted on a slide 43 which can be displaced by a motor 47 via a drive shaft 45. The reference numeral 49 denotes an initiator which determines the number of revolutions of the drive shaft 45. Furthermore, a drive potentiometer 51 is coupled to the shaft 45 via a rigid transmission 53. On the rear of the cage shaft 15 there are provided marks 55, the number of which corresponds to the number of feed reels. The reference numeral 57 denotes an initiator or sensor for processing of the marks 55. An initiator 59 which reacts to a single mark 61 indicates each time a full revolution of the cage shaft 15 is made.

Figure 5:
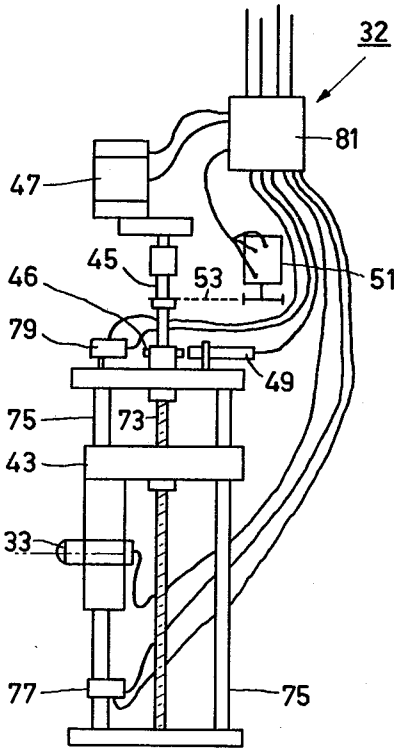
FIGS. 4 and 5 show the units with the transmitter and the receiver, respectively, at an increased scale.
Figure 4:
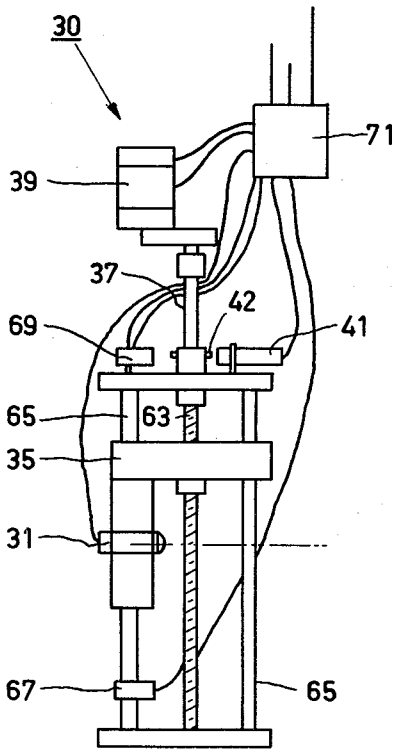

The units 30 and 32 are shown at an increased scale in the FIGS. 4 and 5. The slide 35 is displaced via a threaded spindle 63 which is driven by a motor 39, two rods 65 serving as guides. The reference numerals 67 and 69 denote limit switches. The limit switches 67 and 69 and the initiator 41 are connected to a connection box 71. Similarly, the unit 32 comprises a threaded spindle 73, guides 75, limit switches 77, 79 and a connection box 81. The connection boxes 71 and 81 are connected to a central switch box (not shown).

The operation of the device will now be described. For the stranding of a number of wires D in order to form a conductor C, full feed reels 5 are journalled on the shafts 19 of the cage shaft 15. The individual wires D are guided through bores 16 in the cage shaft 15, are threaded through the stranding nozzle 9, are wrapped around the pull-through disc 11, and are ultimately secured on the take-up reel 13. Subsequently, the motors 12 and 29 are activated. Due to the rotation of the cage shaft 15 with respect to the stationary stranding nozzle 9, the wires D pulled from the feed reels 5 are stranded to form a conductor C with a pitch which depends on the speed of rotation of the cage shaft 15 and on the linear speed of the conductor C which is determined by the speed of rotation of the pull-through disc 11.

The maximum permissible speed of rotation of the cage shaft 15 is determined by the maximum permissible centrifugal forces exerted by the full reels 5 on the suspension construction. As the charge of the reels decreases, the centrifugal forces also decrease when the speed of rotation remains constant, and drop below the permissible value. By gradually increasing the speed of rotation in accordance with the invention as the charge of the reels decreases, a higher production rate can be realized for the same mechanical load. In the embodiment shown in the drawing, the charge of the feed reels 5 is monitored by the light source 31 and the photocell 33. When the device is started, the slides 35 and 43 are in the starting position, and bear against the limit switches 69 and 79, respectively. The units 30 and 32 are arranged with respect to the cage shaft 15 so that the light beam L from the light source 31 is just interrupted by the full reels in the starting position of the slides. The device is started with the maximum number of revolutions permissible for full reels. The signals intercepted by the photocell 33 and the signals supplied by the initiator 57 are simultaneously applied to a counter. For as long as the number of light signals intercepted per revolution is smaller than the number of reels, the counter is reset to zero by the initiator 59 after each revolution; this means that the light beam L is still interrupted by one or more reels. It is only when the charge of all reels has been reduced to such an extent that the light beam L remains uninterrupted in all reel positions that the motors 39 and 47 are actuated via the said counter and via relays (not shown). The slides 35 and 43 with the light source 31 and the photocell 33 are then displaced over a predetermined distance in a direction of the cage shaft 15, so that the light beam L is again interrupted by the reels. For the determination of this distance, use is made of the initiators 41 and 49 which determine the angular rotation of the threaded spindles 63 and 73 by means of marks 42 and 46 provided on the drive shafts 37 and 45, respectively. The control potentiometer 51 is coupled to the drive shaft 45 for the displacement of the photocell 33 via the chain transmission 53; via the potentiometer 51, the speed of rotation of the cage shaft 15 is influenced, i.e. the speed of rotation of the cage shaft is increased as the charge of the reels 5 decreases. Preferably, the electric motor 29 for driving the device is a d.c. motor in view of the simplicity of the control of the speed of rotation. However, control of the number of revolutions is also possible by the influencing of a suitable continuously variable drive.

In the device in accordance with the invention, the number of revolutions is not only increased as the charge of the reels decreases, but the number of revolutions is also limited to a safe level by means of the limit switches 67 and 77. If one of these limit switches is actuated in the extreme position of the slides 35 and 43 the counter is deactivated and the increased speed of rotation reached is maintained at a constant value.

When the device is switched off, a locking relay (not shown) in the power supply for the electric motor 29 is switched because the limit switches 69 and 79 are not actuated. It is only after the slides 35 and 43 have been returned to the starting position by the motors 39 and 47 which rotate in reverse and after the potentiometer 51 has reached its zero position, that the limit switches 69 and 79 are closed so that the contacts of said locking relay are closed and the device can be switched on again. As a result of this safety measure, it is ensured that the device is started again with the lowest number of revolutions, corresponding to full reels, even though it may be that the reels are only partly full.

In the described embodiment, wires D are stranded to form a conductor C. The wires D, however, can also be stranded around a core K which is pulled from a feed reel 14, is fed through the hollow cage shaft 15 and through the stranding nozzle 9, where the wires D are stranded around the core K. As far as the speed control is concerned, the operation is as described above.

The device can be used equally advantageously for the composition of cables in layers of cores or for the armouring and taping of cables where a cable K is fed and provided with a layer of tape or with an armour of steel wires.

With the exception of the take-up reel 13, the rotating parts of the described embodiment are driven by a single electric motor via a common drive shaft. Obviously the separate parts may alternatively be driven by separate synchronized motors.

What is claimed is:

1. A method of manufacturing a stranded product, comprising:

mounting a plurality of feed reels, each containing material wound thereon, in a feed cage, rotating the feed cage about an axis, controlling the speed of the cage rotation, pulling the material from the feed reels through a stranding device, and winding the stranded product onto a take-up reel, characterized in that said rotating and controlling steps comprise:

directing an energy beam past said feed reels such that interruption of the beam by the charge of the material on a feed reel is a function of the size of the charge;

monitoring the charge on a feed reel by sensing the beam energy which passes the reel without interruption; and controlling the speed of cage rotation responsive to said monitoring such that centrifugal force due to rotation of the cage and feed reels is maintained approximately constant at a maximum safe value.

2. A method as claimed in claim 1, characterized in that said directing step includes directing the beam parallel to the axis of rotation of the cage, and the mounting step comprises arranging at least two of said plurality of the feed reels in axial alignment on the cage such that said beam passes said at least two reels simultaneously, thereby sensing the charge of that one of said at least two axially arranged reels which has the largest charge.

3. A method as claimed in claim 2, characterized in that said arranging step includes arranging said plurality of reels in a plurality of axially arranged rows, and said sensing step includes determining when each of said rows is successively aligned adjacent the beam and successively sensing whether of not the beam energy is interrupted by the most fully charged reel of each of said rows.

4. An apparatus for manufacturing a stranded product from a plurality of supplies of material wound on feed reels, comprising a feed cage having an axis, means for rotating the feed cage about said axis, means for mounting a plurality of feed reels to the feed cage, and means for controlling the cage speed responsive to the charge on a feed reel, characterized in that said means for controlling comprises:

a transmitter for emitting an energy beam, and a receiver for the beam, arranged such that the energy beam passes at least two feed reels, means connected to said receiver for determining when the charge on the most-fully-charged of said at least two reels is just sufficiently large to interrupt the beam, and means for controlling the speed of cage rotation responsive to the largest sensed charge sensed by said receiver, whereby the number of transmitters and receivers is less than the number of feed reels whose charge may be sensed.

5. An apparatus as claimed in claim 4, characterized in that said energy beam is arranged to be parallel to said cage axis, and at least two said feed reels are arranged in an axially aligned row, with the reel axes parallel to each other and transverse to the cage axis.

6. An apparatus as claimed in claim 4, characterized in that at least one transmitter and at least one receiver are arranged respectively beyond opposite ends of the drive cage, each transmitter and receiver are mounted on a slide arranged to be radially movable with respect to the cage axis, and the apparatus further comprises a motor for moving each of said respective slides, and a potentiometer coupled to one of said motors and arranged for influencing the speed of rotation of the cage.

7. An apparatus as claimed in claim 4, characterized in that the cage rotates with respect to said transmitter and receiver, and that the apparatus comprises only one said transmitter and only one said receiver, and means for sensing alignment of a feed reel adjacent said beam path.

8. An apparatus as claimed in claim 7, characterized in that said reels are arranged in a given number of angular positions about said cage, said means for controlling comprises a counter, said means for sensing alignment supplies a signal to the counter for each alignment of a reel adjacent said path, said receiver supplies a signal to the counter for each passage of a reel having a charge which allows higher speed, and said means for controlling includes means for increasing the speed when the number of signals from the receiver and the means for sensing alignment are each equal for one revolution of the cage.

9. An apparatus as claimed in claim 4, characterized in that said transmitter and receiver are each mounted on a respective slide arranged for radial movement with respect to the cage axis.

10. An apparatus as claimed in claim 9, characterized by further comprising a limit switch arranged to be engagable by a slide at an extreme position of the slide, said limit switch permitting rotation of the cage at a maximum speed of rotation.

11. An apparatus as claimed in claim 10, further comprising a pair of limit switches arranged to sense that the respective slides are in the extreme positions corresponding to full charge, and a locking relay arranged to prevent re-starting of the means for rotating the cage after stoppage thereof, unless said pair of limit switches are activated.

* * * * *